US007180276B2

(12) United States Patent
Telecco

(10) Patent No.: US 7,180,276 B2
(45) Date of Patent: Feb. 20, 2007

(54) DUAL STAGE VOLTAGE REGULATION CIRCUIT

(75) Inventor: Nicola Telecco, Santa Clara, CA (US)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 11/402,730

(22) Filed: Apr. 12, 2006

(65) Prior Publication Data

US 2006/0186869 A1 Aug. 24, 2006

Related U.S. Application Data

(62) Division of application No. 10/666,324, filed on Sep. 17, 2003, now Pat. No. 7,064,529.

(51) Int. Cl.
*G05F 1/577* (2006.01)

(52) U.S. Cl. ..... 323/267; 323/266; 323/268; 323/282; 327/536; 363/60

(58) Field of Classification Search ..... 323/266, 323/267, 268, 269, 273, 274, 279, 281, 282, 323/284; 363/59, 60; 327/148, 157, 536
See application file for complete search history.

(56) References Cited

U.S. PATENT DOCUMENTS

| | | | | |
|---|---|---|---|---|
| 4,835,455 | A | 5/1989 | Coddington et al. | 323/314 |
| 4,942,312 | A | 7/1990 | Stevens | 307/296.8 |
| 5,831,845 | A | 11/1998 | Zhou et al. | 363/60 |
| 6,114,845 | A | 9/2000 | Capici et al. | 323/313 |
| 6,188,212 | B1 | 2/2001 | Larson et al. | 323/281 |
| 6,194,887 | B1 | 2/2001 | Tsukada | 323/315 |
| 6,232,753 | B1 | 5/2001 | Pasotti et al. | 323/267 |
| 6,356,062 | B1 * | 3/2002 | Elmhurst et al. | 323/282 |
| 6,359,797 | B1 * | 3/2002 | Bayer et al. | 363/60 |
| 6,362,612 | B1 | 3/2002 | Harris | 323/312 |

(Continued)

OTHER PUBLICATIONS

P. Cappelletti et al., Flash Memories, Kluwer Academic Publishers, 1999, pp. 332-335. (6 pgs.)

*Primary Examiner*—Gary L Laxton
(74) *Attorney, Agent, or Firm*—Schneck & Schneck; Thomas Schneck

(57) ABSTRACT

A voltage regulator for supplying two types of loads on a common chip, namely a high current load and a low current load. The voltage regulator employs a feedback loop to supply the low current load with a fine degree of regulation and a feed forward arrangement to supply the high current load with a coarse degree of regulation. The feedback loop employs a bandgap reference source feeding a comparator, with an output driver transistor drawing current from a common supply and having an output electrode connected to a voltage divider, allowing a sample of the output to be fed back to the comparator to maintain the desired output voltage. The output electrode also feeds a control transistor for the feed forward arrangement that also draws current from the common supply and supplies the high current load directly. An example of a single chip circuit employing the present invention is a charge pump where the high current load is a series of large capacitors used to multiply charge to produce a high voltage and the low current load is a plurality of clock circuits that apply timing pulses to switches for proper phasing of the capacitors and associated switches to achieve the desired high voltage.

9 Claims, 3 Drawing Sheets

U.S. PATENT DOCUMENTS

| | | | | |
|---|---|---|---|---|
| 6,369,552 | B2 | 4/2002 | Goyhenetche et al. | 323/266 |
| 6,400,211 | B1 | 6/2002 | Yokomizo et al. | 327/536 |
| 6,462,526 | B1 | 10/2002 | Tanase | 323/313 |
| 6,525,595 | B2 | 2/2003 | Oku | 327/536 |
| 6,617,832 | B1 * | 9/2003 | Kobayashi | 323/266 |
| 6,686,728 | B2 | 2/2004 | Nakajima | 323/281 |
| 7,064,529 | B2 * | 6/2006 | Telecco | 323/267 |

* cited by examiner

DUAL STAGE VOLTAGE REGULATION CIRCUIT

CROSS-REFERENCE TO RELATED APPLICATION

This is a divisional application of U.S. patent application Ser. No. 10/666,324 filed Sep. 17, 2003 now U.S. Pat. No. 7,064,529.

TECHNICAL FIELD

The invention relates to voltage regulation circuits and, in particular, to a voltage regulator for an integrated circuit charge pump.

BACKGROUND ART

Voltage regulators for integrated circuits provide constant voltages to loads where the constant voltages are less than that of a common voltage, typically derived from a battery or other power supply, termed $V_{cc}$. Ordinarily the constant voltage, adjusted by voltage dropping circuits or resistors, is sufficient for most chip needs, except when much higher voltages are required, such as for programming EEPROM memory chips, where the programming voltage, $V_{pp}$, can be many times $V_{cc}$. In this situation a charge pump is used to boost $V_{cc}$ to the $V_{pp}$ level.

There are two major types of voltage regulators. A first type employs voltage sampling and comparison to a reference voltage. This type is commonly known as a feedback voltage regulator. A second type merely employs the reference voltage as part of a power supply circuit without comparison.

It has been realized in the prior art that a bandgap circuit is a useful tool for establishing the reference voltage, less than the power supply voltage $V_{cc}$. The bandgap circuit is combined with other circuit elements to derive desired regulated voltages. A bandgap voltage reference circuit relies on the basic physics of semiconductor materials to reliably establish a particular voltage. For example, in transistors, the bandgap voltage is closely related to a characteristic base-emitter voltage drop, $V_{be}$, of a bipolar transistor. Many bandgap voltage reference circuits have been developed, one of which may be seen in U.S. Pat. No. 6,362,612 to L. Harris, which adapts the base-emitter characteristic of bipolar transistors to operate CMOS driver transistors.

Because bandgap circuits are well known in the art, they are commonly used as building blocks in more sophisticated voltage regulation circuits. For example, in U.S. Pat. No. 5,831,845 to S. Zhou, et al., it is shown how reference voltages, derived from bandgap voltage reference circuits, may be used to establish voltage regulation for an integrated circuit charge pump. S. Zhou, et al., explain that prior art voltage regulators use a pair of serially-connected capacitors of different sizes to achieve regulation. A first reference voltage is applied at a node between the two capacitors and a second reference voltage to a comparator, which controls the operation of the charge pump. The second reference voltage is slightly smaller than the first. There is sometimes a problem in the comparator incorrectly establishing the high voltage output and so S. Zhou, et al., provided an improved balanced capacitor voltage divider approach to voltage regulation for charge pumps.

As seen from the patent to S. Zhou, et al., several different voltages can be required. While most transistors are designed to operate at low voltage levels established from a regulated $V_{cc}$ supply, EEPROM transistors require a programming voltage which is several times higher than $V_{cc}$, supplied from a charge pump. At the same time, since diverse voltage requirements appear at different regions of a chip, a chip-wide approach is needed for supplying these requirements without constructing a multiplicity of voltage regulators at various locations on a chip for different needs. However, in circuits such as charge pumps, involving rapid switching, voltage regulators may experience difficult operating conditions. When there is an abrupt current demand from a switch, voltage will initially drop until the regulator has time to compensate. With many switches all making near simultaneous start-stop current demands, a voltage regulator may become unstable and unable to provide a reliable supply to an entire chip.

An object of the invention was to provide a versatile, yet stable, voltage regulator for an integrated circuit that would also supply constant voltages for diverse circuit needs, even where high speed switching is involved.

SUMMARY OF THE INVENTION

The above objects have been met with a dual stage voltage regulator circuit, including a first stage for low current, low noise circuits and a second parallel stage for high current, high noise circuits, with the two parallel stages cooperatively sharing a resistive voltage divider for stability. The first stage resembles a closed loop regulator of the prior art wherein a comparator receives an input from a reference circuit and an input from a voltage dividing resistor network, both the reference circuit and the resistor network connected to a common supply voltage. The output of the comparator is fed to a control element for a first current driver device which has a first output line carrying a first output voltage and a first current. The second stage resembles an open loop regulator where a second current driver device is connected to the common supply voltage and operates as a voltage clamp, dropping a characteristic voltage under control of the first output voltage. The first and second parallel stages drive parallel loads of the same integrated circuit chip.

The first regulator stage is very accurate and fine, but is inherently slow because of the feedback around the comparator and through the resistor network. This stage is used for low current devices, as well as low noise devices and low voltage analog circuits. The second regulator stage is not as accurate, not having a feedback loop, but can rapidly supply large amounts of current because the second stage is connected directly to the supply voltage through the second current driver.

Each of the two stages employs a current driver, i.e. a transistor connected to the common voltage supply. A number of parallel current drivers may optionally be arranged at multiple needed locations on a chip, while the comparator, divider resistors, and reference voltage circuit can be optionally located at a single fixed location.

For example, in a charge pump, a number of high-current carrying clock boosters, connected in parallel through switches, serve to boost charge over connected capacitors. Clock circuits are used to flip switch states. A path leads from the switches and clock circuits back to the resistor divider network which assists in maintaining circuit stability.

BEST MODE FOR CARRYING OUT THE INVENTION

Figure 1:
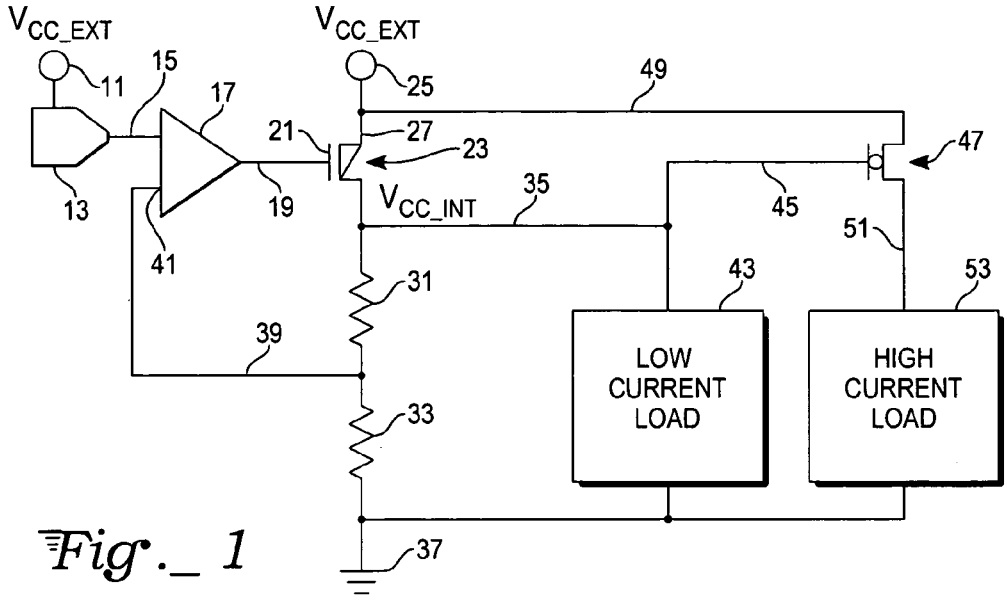
FIG. 1 is a circuit plan for a voltage regulator in accordance with the present invention.

With reference to FIG. 1, an external integrated power supply voltage, typically 3.3 volts or 5 volts is applied at terminal 11, labeled $V_{ccext}$. This voltage powers a band gap reference generator 13 which produces a known stable output voltage along line 15. Bandgap reference generators produce reliable and consistent voltages based upon conduction principles of semiconductor devices, i.e. bandgaps. Construction of bandgap reference generators is widely understood. The line 15 is connected as a reference input to comparator 17 for comparison with a signal applied at comparator terminal 41. When the bandgap voltage exceeds the signal at terminal 41, the comparator is enabled producing a voltage related to the bandgap voltage on output line 19 which controls gate 21 of the p-type enhancement MOS transistor 23. This transistor has a source line 27 connected to the $V_{ccext}$ terminal 25 so that an adequate amount of current is available to both transistor 23 and a parallel native (near zero threshold) PMOS transistor 47 along line 49. These currents will be used to power circuits on an integrated circuit chip.

When the output of comparator 17, taken along line 19 activates transistor 23, current flows into the resistor divider network formed by resistors 31 and 33, flowing to ground terminal 37. Preferably, resistors 31 and 33 are matched, selected to provide a desired voltage drop. Some current is taken from the drain of transistor 23, along line 35 and the voltage along this line is known as $V_{ccint}$, a voltage typically 1.8 volts. This output voltage is used to drive low current circuits as well as low voltage circuits, including analog circuits. Resistor 31 drops voltage relative to the voltage on line 35 and this voltage, taken along line 39 feeds comparator 17 at input terminal 41. So long as the voltage does not exceed the bandgap voltage on terminal 15 of the comparator, the transistor 23 will continue to source current to circuits 43. If the voltage on line 39 exceeds the bandgap voltage on line 15, the comparator will momentarily be shut down or reverse polarity, essentially throttling transistor 23, lessening the current available in the low current circuits 43. However, although current is throttled, voltage on line 35 remains constant.

The external voltage available at terminal 25 is the same voltage available at terminal 11 and is also available to the NMOS transistor 47 along line 49. The internal reference voltage along line 35 is transferred to line 45 connected to the gate of transistor 47 and establishes conduction for the transistor 47 which preferably has a conduction threshold of approximately zero volts. The output of transistor 47 is taken along line 51 and is another internal reference voltage feeding the high current circuit 53. Transistor 47 feeds the high current load 53 directly and can be scaled to handle sufficient current for the load. Alternatively, parallel transistors, constructed identically to transistor 47 can feed similar loads at other locations on an integrated circuit chip.

It is seen that the regulator circuit feeding load 43 has feedback associated with comparator 17 through the resistor divider network employing resistors 31 and 33, with an output taken from between resistors 31 and 33 along line 39. The feedback loop has an inherent delay and so there is inherent stability. Even if comparator 17 is momentarily shut down or has its polarity reversed, some conduction will still occur through transistor 23 and collective feedback will establish the proper internal supply voltage. On the other hand, high current devices associated with load 53 do not require a precision reference voltage and so the reference voltage obtained across transistor 47 is sufficient.

Figure 2:
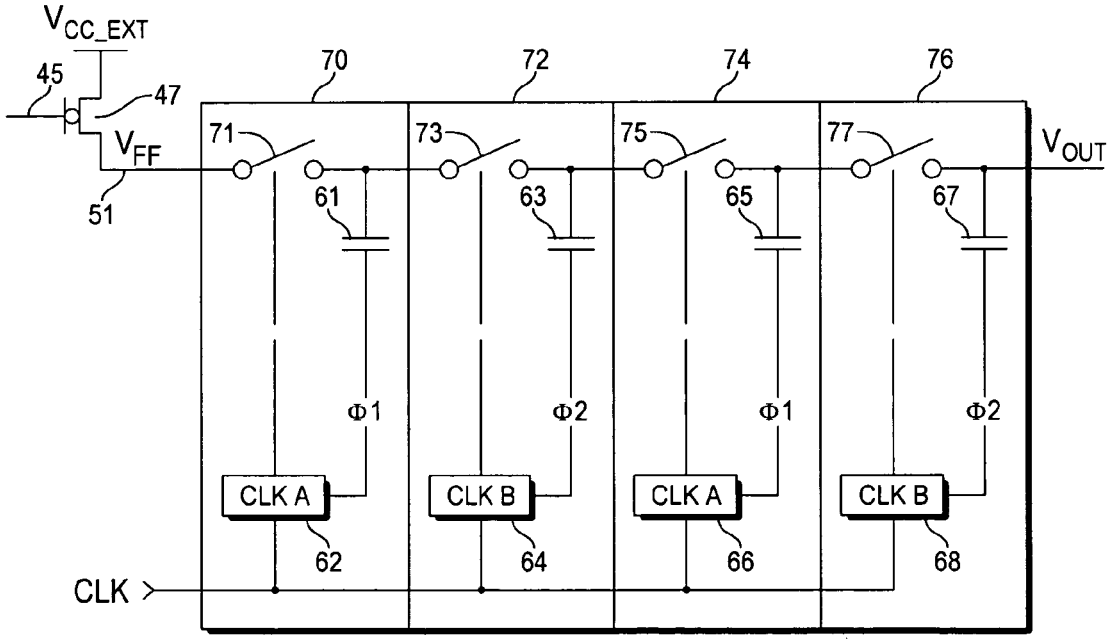
FIG. 2 is a circuit plan for an ideal charge pump employing a voltage regulator shown in FIG. 1.

FIG. 2 shows one use of the voltage regulator of FIG. 1 for regulating a charge pump circuit. Such a pump might raise a local supply voltage, $V_{cc}$, of 3.3 volts to a much higher supply voltage, $V_{OUT}$, of 14 volts, useful for programming EEPROMs. Parallel connected clock booster stages 70, 72, 74 and 76 having capacitors 61, 63, 65, 67 are clocked by two phases, 180 degrees apart. The phases are shown as $\phi 1$ and $\phi 2$ with clock generators 62, 64, 66 and 68 synchronized by a common clock input CLK and connected to corresponding capacitors and to switches 71, 73, 75 and 77. Such a phased capacitor circuit is described in the book "Flash Memories" by P. Cappelletti, p. 332. The high current n-type depletion MOS transistor 47, activated by a signal on gate 45, shown in FIG. 1, provides an internal supply voltage, termed $V_{FF}$ for feed forward regulation to charge node 51 to an initial condition. The boost circuits 72, 74 and 76 take the output of the node 51 across switch 71 and increase voltage by boosting using the phased capacitors 61, 63, 65 and 67.

Figure 3:
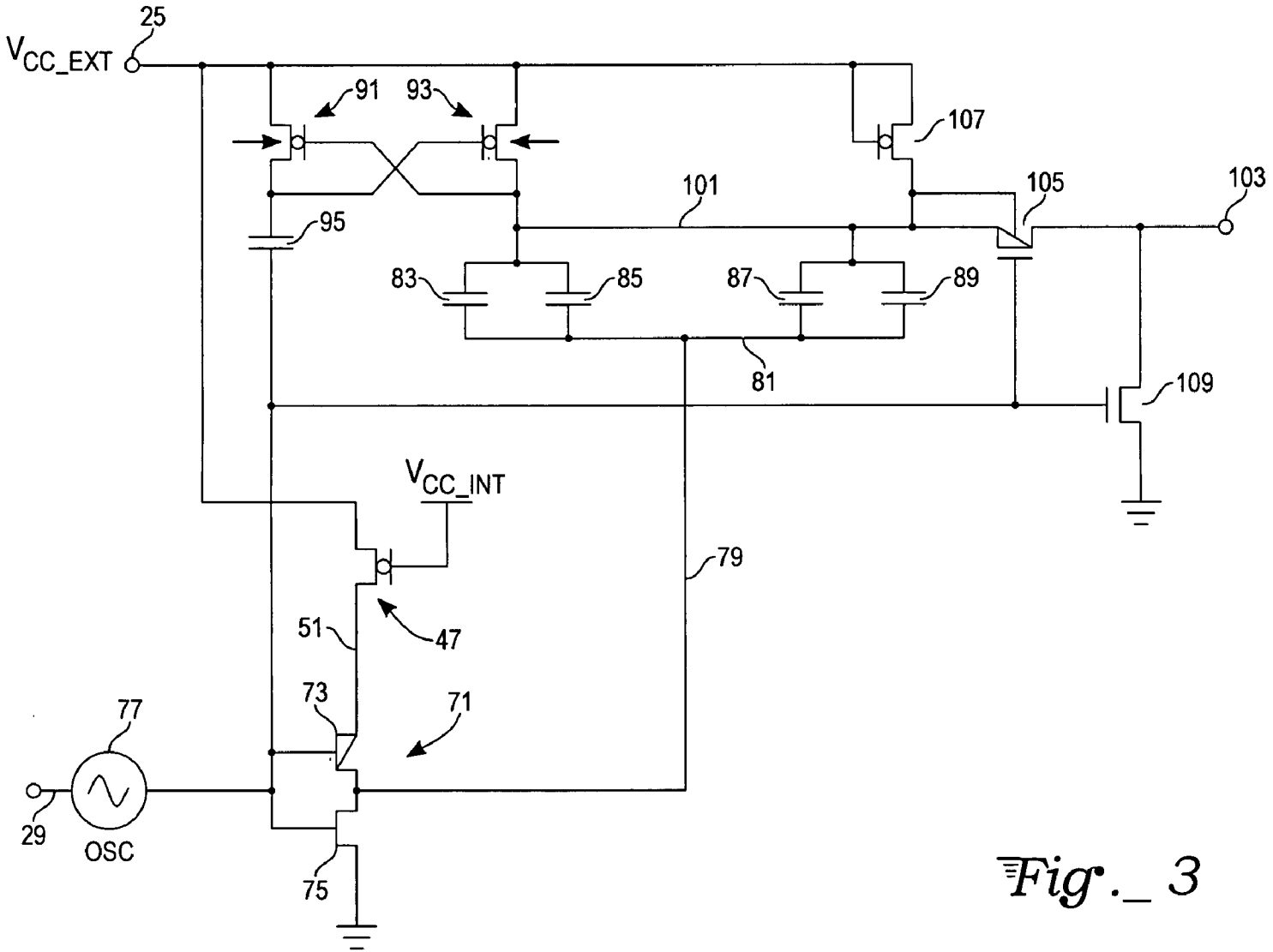
FIG. 3 is a schematic diagram of a typical clock booster circuit used in the circuit plan of FIG. 2.

With reference to FIG. 3, one of the clock circuits with an associated capacitor, such as clock circuit 62 and adjoining capacitor 61, shown in FIG. 2, are illustrated using two regulated output voltages, shown in the circuit of FIG. 1. A first voltage is the external $V_{cc}$ voltage shown to pass through transistor 47 to the high current load 53 in FIG. 1. In FIG. 3, transistor 47 has been redrawn from FIGS. 1 and 2 and receives the external $V_{cc}$ voltage from terminal 25, with the transistor output on line 51 going to inverter 71. The inverter is formed by the p-channel transistor 73 and n-channel transistor 75 driven by a pulse train from oscillator 77. This oscillator has a voltage supply associated with a low current load, such as the voltage on line 35 in FIG. 1. The output of oscillator 77 provides a low voltage first pulse train drive to the gates of the two transistors forming the inverter 71.

The output of inverter 71 steps up both voltage and current of the pulse train and is taken along line 79. This output will be a second pulse train having an inverse phase from the input or first pulse train from the oscillator 77. The second pulse train is applied to the line 81 which is connected as a common line to parallel capacitor pairs 83, 85 and 87, 89. Parallel capacitors behave as series resistors in the sense of being additive. The parallel capacitors are being charged at a rate determined by oscillator 77 which is pumping the capacitors. The opposite side of the capacitor bank has the opposite induced charge which causes switching of the cross-coupled transistors 91 and 93. The switching transistors alternately pull current from $V_{cc}$ terminal 25. Any current through the transistor pair 91 and 93 that is not momentarily reflected into the capacitor pairs 83, 85, and 87, 89 is buffered by capacitor 95. The buffered capacitor 95 resonates with the pulse train from oscillator 77 along line 97.

Output current from the cross-coupled transistor pair 91, 93 appears along line 101 to communicate with capacitor pairs 83, 85 and 87, 89. The pulsed capacitors cause the output line 101 to oscillate at the frequency of oscillator 77. Output line 101 is also connected to output terminal 103 through the gate of pass pull-up transistor 105. Voltage on line 101 has phases to drive the switches 71, 73, 75 and 77 shown in FIG. 2. Voltage stabilization to line 101 comes from transistor 107 which is tied to the internal $V_{cc}$ at terminal 25. The voltage on output node 103 is stabilized by pull-down transistor 109 having a gate tied to capacitor 95, as well as the gates of transistor 73 and 75, with transistor 107 also providing bias voltage for the N well of transistor 105, allowing oscillator 77 to strongly influence the phase of the high current output pulses at terminal 103. A number of similar circuits is connected to each switch in FIG. 2.

The clocking circuits apply alternate phases to switches 71, 73, 75, 77. In this manner, the high current, high noise, large capacitors receive a current supply whose voltage is only lightly regulated. On the other hand, the clock circuits employing CMOS transistors, receive a low current supply whose voltage is tightly regulated in a feedback loop.

Figure 4:
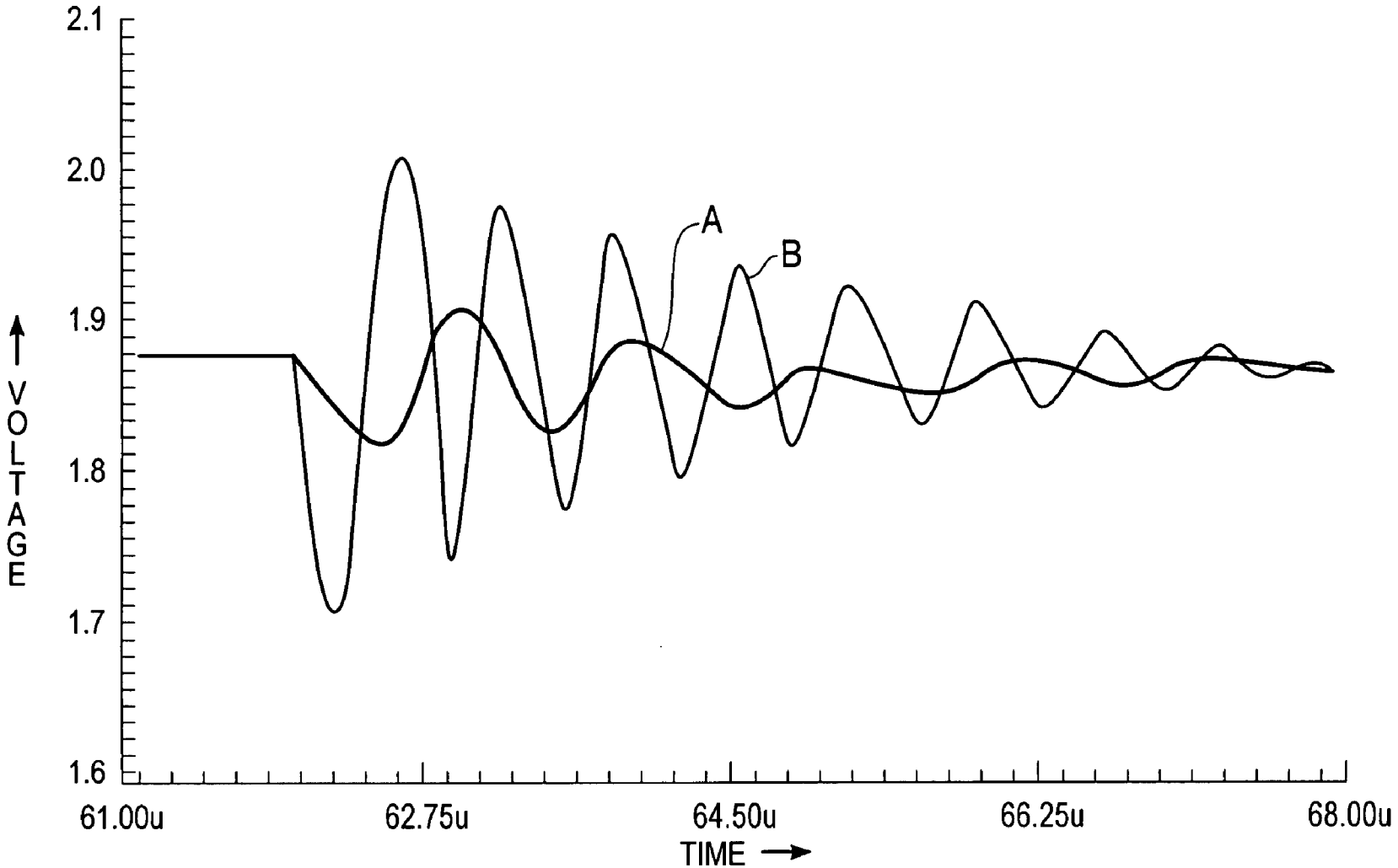
FIG. 4 is a plot of $V_{cc}$ on the vertical axis versus time on the horizontal axis for a dual stage regulator of FIG. 1 versus a single stage regulator of the prior art.

With regard to FIG. 4, the "A" plot shows a plot of the internal $V_{cc_int}$ for a typical dual stage voltage regulator in accordance with the present invention. Note that the voltage ripple is rapidly attenuated from the initial charging of the capacitors. On the other hand, the "B" plot represents a typical single stage regulator outputting $V_{cc}$ without dual stage feedback. There is a large initial oscillation of $V_{cc_int}$ as large capacitors are charged, slowly attenuated as charging is completed, until switches are closed and the process repeats. The superiority of the dual stage regulator is apparent.

The invention claimed is:

1. A voltage regulator in a charge pump circuit, comprising:

a first regulator stage connected to a common supply and having a feedback loop in relation to a voltage comparator with an output line driving an oscillator producing a low voltage pulse train; and a second regulator stage connected to a common supply and having a voltage clamp in parallel to said feedback loop with an output line driving a series arrangement of clock circuits with associated capacitors in a phased relation stepping the common supply voltage to a higher level.

2. The voltage regulator of claim 1, wherein the first regulator stage comprises said comparator and an output transistor, the output transistor having an output electrode communicating with the second regulator stage and with the comparator.

3. The voltage regulator of claim 2, further comprising a voltage divider network connected to the output electrode of the output transistor.

4. The voltage regulator of claim 3, wherein the voltage divider network comprises a matched pair of transistors.

5. The voltage regulator of claim 1, wherein a bandgap regulator is connected between the common supply and the voltage comparator.

6. A voltage-regulated charge pump circuit, comprising:

a plurality of high-current boost stages, each boost stage having a capacitor coupled to a switch, the plurality of stages connected together through the switches;

a plurality of clock circuits associated with the plurality of boost stages, the plurality of clock circuits connected in parallel to a common clock input to receive a low voltage pulse train from an oscillator, each of the clock circuits constructed to generate a clock signal synchronized with the common clock input such that the plurality of clock circuits for adjacent boost stages generate clock signals that are 180 degrees apart in phase, the clock signal generated by each clock circuit being coupled to the capacitor and to the switch of an associated boost stage, switch states of the switches being flipped by the clock signals;

a low current regulator stage including a bandgap regulator connected to a common supply voltage, a comparator having a first input connected to the bandgap regulator, a low current first output transistor connected to the common supply voltage with a control gate connected to an output of the comparator, a voltage divider with a first connection to an output of the low current first output transistor and a second connection providing a feedback path to a second input of the comparator, the output of the low current first output transistor powering the oscillator; and a high current regulator stage including a high current second output transistor connected to the common supply voltage with a control gate connected to the output of the low current first output transistor, an output of the high current second output transistor connected to a first of the plurality of boost stages so as to drive the capacitors of the boost stages in a phased relation stepping the common supply voltage to a higher level.

7. The voltage-regulated charge pump circuit as in claim 6, wherein the high current second output transistor comprises a depletion NMOS transistor.

8. The voltage-regulated charge pump circuit as in claim 6, wherein the voltage divider comprises a pair of matched resistors in series with the second connection providing the feedback path being located between the pair of resistors.

9. The voltage-regulated charge pump circuit as in claim 6, wherein each of the plurality of clock circuits comprises parallel first and second capacitor banks coupled to receive respective pulse and inverse pulse trains from the oscillator via a high current inverter in a path of one of the parallel capacitor banks, the capacitor banks both connected to a pair of cross-coupled switching transistors powered by the common supply voltage, and a pass transistor connected between one capacitor bank and a clock output, the pass transistor gated by the pulse train from the oscillator.

* * * * *